US005854611A

United States Patent [19]

Gans et al.

[11] Patent Number: 5,854,611

[45] Date of Patent: Dec. 29, 1998

[54] POWER SHARED LINEAR AMPLIFIER NETWORK

[75] Inventors: Michael James Gans, Monmouth Beach; Yu Shuan Yeh, Freehold, both of N.J.

[73] Assignee: Lucent Technologies Inc., Murray Hill, N.J.

[21] Appl. No.: 506,286

[22] Filed: Jul. 24, 1995

[51] Int. Cl.[6] ..... H01Q 3/22

[52] U.S. Cl. ..... 342/373; 342/374

[58] Field of Search ..... 342/373, 377, 342/374, 375; 333/109, 117

[56] References Cited

U.S. PATENT DOCUMENTS

| | | | |
|---|---|---|---|
| 3,480,885 | 11/1969 | Schrank . | |
| 3,731,217 | 5/1973 | Gerst et al. . | |
| 3,917,998 | 11/1975 | Welti . | |
| 4,316,192 | 2/1982 | Acoraci . | |
| 4,618,831 | 10/1986 | Egami et al. | 330/124 R |
| 4,652,879 | 3/1987 | Rudish et al. . | |
| 4,882,588 | 11/1989 | Renshaw et al. . | |
| 4,907,004 | 3/1990 | Zacharatos et al. . | |
| 4,951,061 | 8/1990 | Lee . | |
| 4,965,587 | 10/1990 | Lenormand et al. . | |
| 4,965,605 | 10/1990 | Chang et al. | 343/700 MS |
| 5,086,302 | 2/1992 | Miller . | |
| 5,093,668 | 3/1992 | Sreenivas . | |
| 5,105,170 | 4/1992 | Joshi . | |
| 5,179,386 | 1/1993 | Rudish et al. . | |
| 5,325,101 | 6/1994 | Rudish et al. . | |

OTHER PUBLICATIONS

Anaren Brochure for Microwave Components.
Northern Telecom, Inc. Brochure for Smart Antennas.

*Primary Examiner*—Gregory C. Issing

[57] ABSTRACT

The present invention relates to an antenna system utilizing a power sharing network to facilitate linear operation of power amplifiers by equally distributing an electromagnetic communication signal to the plurality of power amplifiers provided in the antenna system of the present invention. The power sharing network configuration enables linear power amplifier sharing with an input signal. In particular, the present invention antenna system provides a circuit arrangement providing a greater number of linear power amplifiers relative to antenna elements provided.

8 Claims, 9 Drawing Sheets

POWER SHARED LINEAR AMPLIFIER NETWORK

BACKGROUND OF THE INVENTION

1. Field of the Invention

This invention generally relates to a power shared linear amplifier network which includes a plurality of amplifiers which are arranged to equally amplify an input communication signal, and more particularly relates to an antenna system incorporating a greater number of amplifiers than antenna elements provided.

2. Description of Related Art

It is desirable to configure a system to receive and transmit all of the electromagnetic signals within a transceiver's capability as limited by sensitivity and bandwidth. Signals of interest are usually incident from widely diverse directions. Therefore, prior art methods have utilized antennas having a wide azimuth beam width, such as omni directional broadbeam antennas, as the systems receptor and transmitter element.

A severe limitation of this approach is that it does not permit directional narrowbeam resolution of multiple signals. Such resolution is usually desirable to prevent garbling of signals that cannot otherwise be resolved in frequency or time-of-occurrence. Directional resolution is also desirable in cases where the direction of incidence of the signals is to be estimated.

An attempt to overcome the above mentioned disadvantages is the utilization of narrow-beam antennas. In such a system, multiple antennas, each producing a narrow beam, are arranged in a circular pattern wherein their RF beams are contiguous and point radially outward. In yet another system, a single cylindrical array antenna is configured to form multiple RF beams which are contiguous and point radially outward. Therefore, in both aforementioned systems, each RF beam port of the antenna(s) is connected to a separate dedicated transceiver, power amplifier and associated antenna components, enabling its respective system to exhibit the advantages of both good directional resolution and complete simultaneous directional coverage. Further advantages provided are reduction in co-channel interference, reduction in the RF signal delay spread, reduction in amplifier power and reduction in the required number of cell sites.

However, there are shortcomings associated with the above-mentioned systems. Such shortcomings include the high cost of multiple dedicated receivers and transmitters which are compartmentalized by each RF beam. Further, when many narrow RF beams are present at a cell site, the traffic in each RF beam may fluctuate. Moreover, a narrowbeam antenna typically requires a large antenna aperture, and when there are N narrow RF beams, the required antenna aperture is N times larger.

Yet another severe limitation of the aforementioned narrowbeam antenna systems are the provision of multiple dedicated power amplifiers being individually coupled to each RF beam port of the aforementioned antenna(s). Such dedicated amplifiers are both costly and inefficient in view of that a single power amplifier may operate with a considerable higher output power level at any given time in comparison to the remaining power amplifiers of the antenna system since a particular RF beam of the antenna system may have to handle considerably more RF signal traffic in comparison to the remaining RP beams of the prior-art antenna system.

Thus, there exists a need to provide an antenna system which enables the sharing of the base station antenna associated components (i.e., transmitters, receivers and signal amplifiers) by all narrow electromagnetic beams at a cell site base station. Such sharing will facilitate increased trunking efficiency as well as enable the handling of unexpected concentrations of calls from a particular electromagnetic beam, such as during rush hour jams.

SUMMARY OF THE INVENTION

The present invention relates to an antenna system which incorporates a power sharing network for enabling equal component distribution in conjunction with an electromagnetic signal being processed therein. The antenna system includes a plurality of antenna elements for providing directional narrowbeam resolution of multiple electromagnetic transmission beams. The antenna system further includes a first power sharing network coupled to a plurality of linear power amplifiers, which in turn are coupled to a second power sharing network. Preferably, the first and second power sharing networks each include a Butler Matrix. The plurality of antenna elements are respectively coupled to the output ports of the second power sharing network. In particular, there is provided a greater number of linear power amplifiers than antenna elements provided.

The first power sharing network is operative to equally distribute a received input signal from one of its input ports to the plurality of linear power amplifiers coupled thereto in substantially equal power levels and being staggered in phase relative to one another. The plurality of linear power amplifiers then independently amplify each aforementioned respective output signal of the first power sharing network. The second power sharing network is operative to receive the aforementioned phase staggered amplified signals (which are a function of the input signal) and provide an output signal which has an average power level relative to the combined power level of each aforementioned phase staggered amplified input signal to the second power sharing network. The averaged output signal is then applied to one of the narrowbeam antennas whereby it is radiated therefrom in a directional electromagnetic narrowbeam transmission signal

BRIEF DESCRIPTION OF THE DRAWINGS

The foregoing features of the present invention will become more readily apparent and may be understood by referring to the following detailed description of an illustrative embodiment of an apparatus according to the present invention, taken in conjunction with the accompanying drawings, in which.

DETAILED DESCRIPTION OF THE PREFERRED EMBODIMENTS

Figure 1:
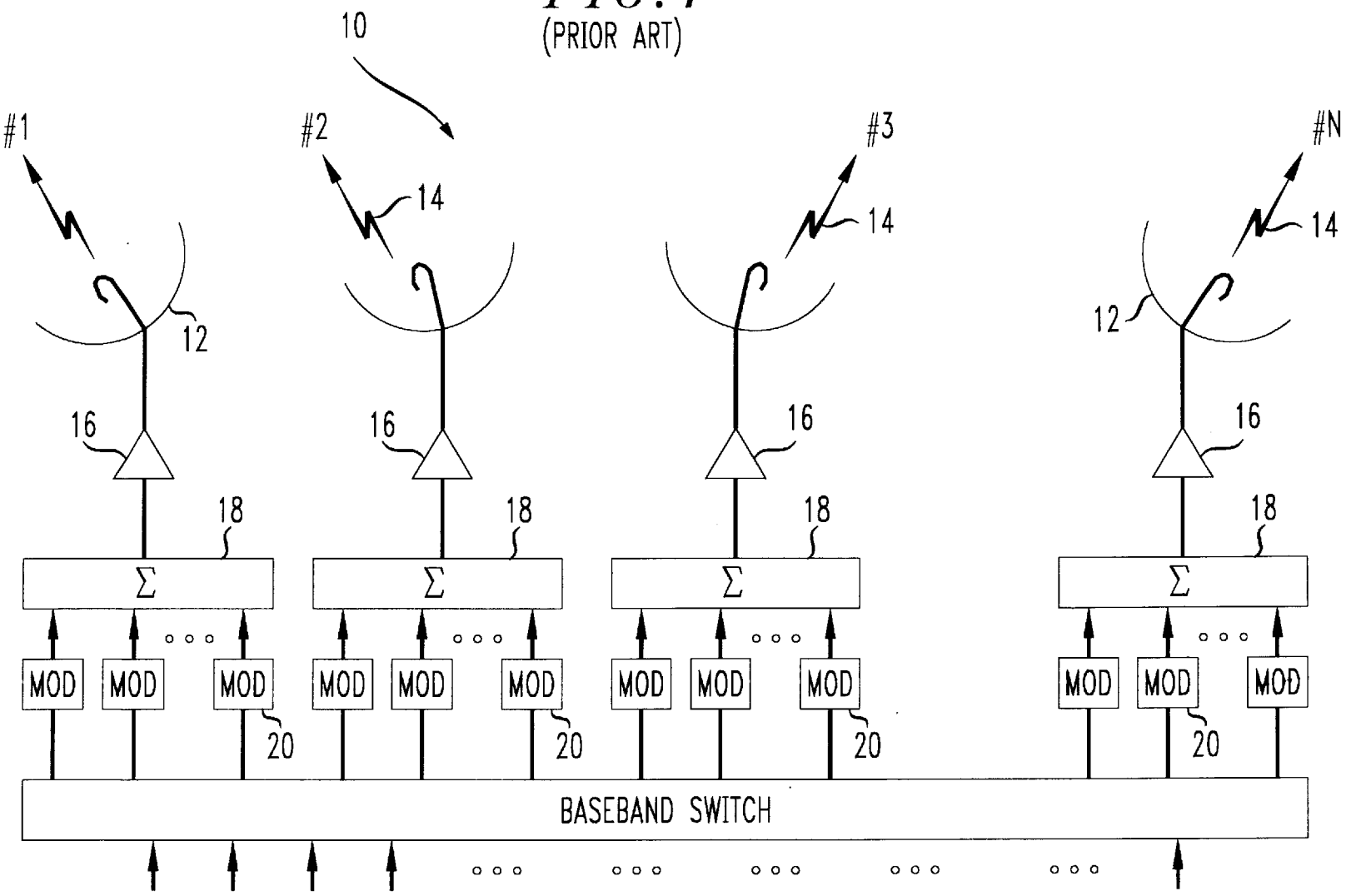
FIG. 1 (PRIOR ART)
FIG. 1 is a block diagram of a compartmentalized antenna base station illustrating a prior art system.

Referring now to the drawings, in which like reference numerals identify similar or identical elements, FIG. 1 illustrates a prior art example of a compartmentalized narrow beam antenna base station, designated generally by reference numeral 10. The base station 10 includes N narrow beam antennas 12, with each narrow beam antenna 12 having an associated electromagnetic beam 14. Further, each narrow beam antenna 12 is coupled to a dedicated power amplifier 16 which in turn is coupled to a summing circuit 18. Each summing circuit 18 is further coupled to M modulators 20, wherein there are M modulators 20 per electromagnetic beam 14. Thus, the N-beam base station 10 is ideally configured to serve M×N RF channels. However, in commercial applications the aforementioned N-beam base station 10 is unable to serve M×N RF channels, since calls are blocked at a much higher rate because channels are not shared between beams.

Further, in the event of a heavy concentration of users utilizing a particular beam, an individual narrowbeam antenna 12 may be required to transmit to the aforementioned heavy concentration of users. To accommodate the increased usage, the power amplifier 16 of the narrow beam antenna 12 associated with the aforementioned heavy concentration of users will have to increase its output power to such a level which may potentially overload the aforementioned power amplifier 16.

Figure 2:
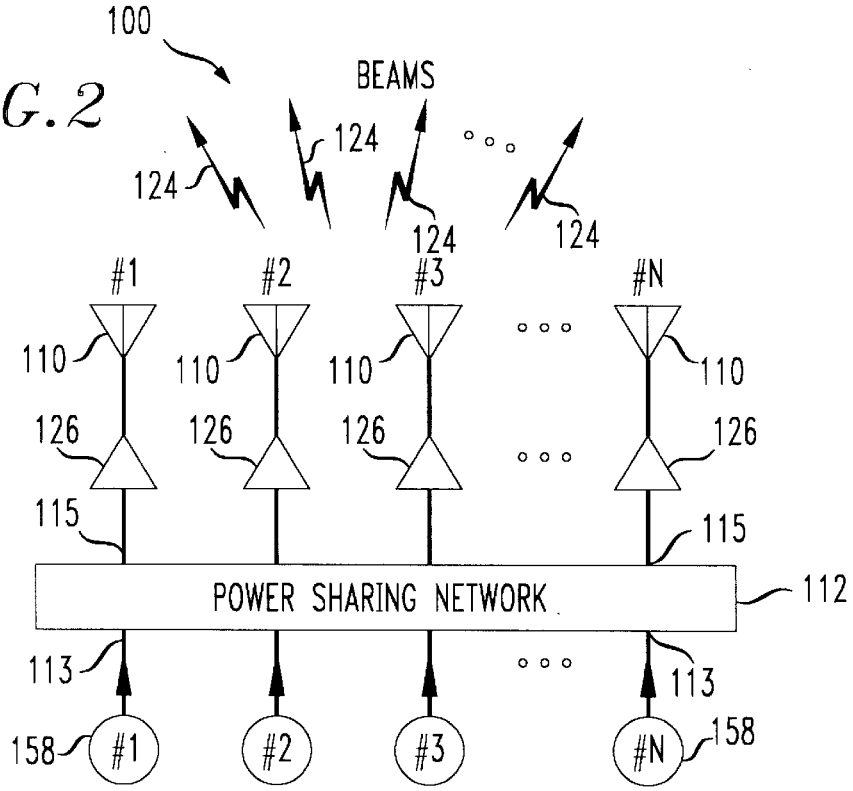
FIG. 2 is a block diagram of an antenna system having a power sharing network operative to enable equal antenna component distribution in accordance with the present invention.

FIG. 2 illustrates an antenna system constructed in accordance with the present invention and designated generally by reference numeral 100. Antenna system 100 has N broadbeam antenna elements 110 coupled to a power sharing network 112. Briefly, as will be described in more detail below, the power sharing network 112 preferably includes N input ports 113 and N output ports 115, and is operative such that when an input signal is applied to one of its input ports 113, a plurality of output signals (which are a function of the input signal) are provided at the N output ports 115 in equal power levels and staggered in a predefined angular phase relationship to one another. The power sharing network may encompass any known circuitry such as quadrature hybrids, lange couplers, branchline couplers or any equivalent structure adapted to receive an input signal and provide at least two output signals in substantially equal power levels and staggered in a predefined angular phase relationship to one another. Typically, the output signals have a angular phase stagger relative to one another of:

$$\frac{\pm(2K-1)180^\circ}{N}$$

wherein ±K is the beam number.

Figure 3:
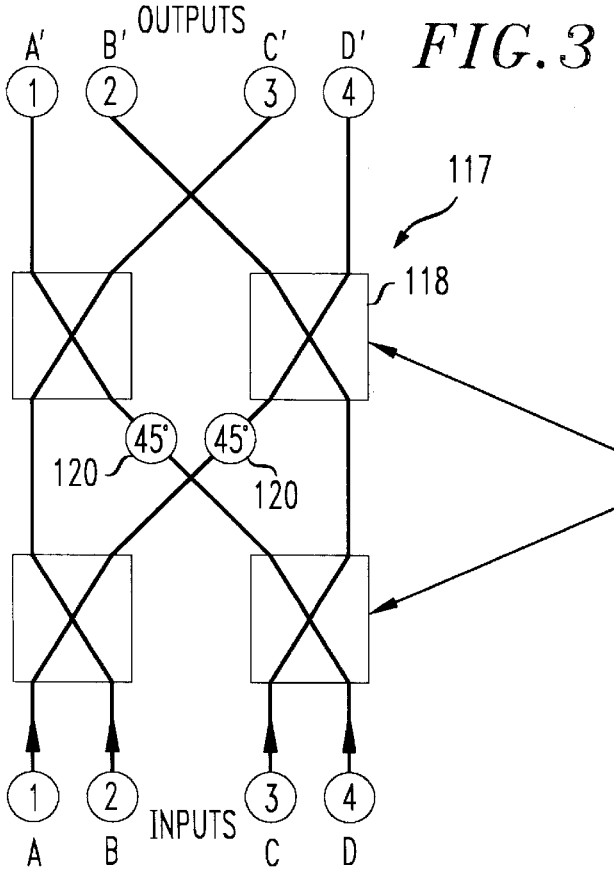
FIGS. 3 and 3*a* are simplified block diagrams of a four port Butler Matrix implemented in the power sharing network of the antenna system of the present invention in accordance with a preferred embodiment.
Figure 3A:
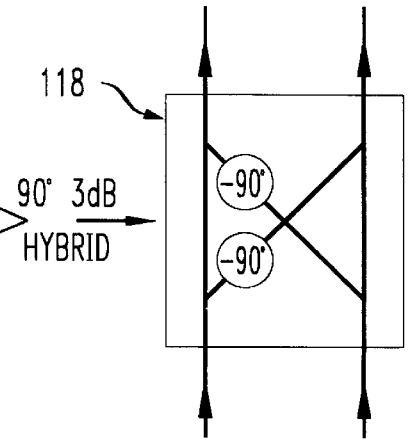

With reference now to FIGS. 3 and 3*a*, and in accordance with a preferred embodiment of the present invention, the power sharing network 112 is to be described in terms of a Butler Matrix device, designated generally by reference numeral 117. Butler Matrix 117 is a passive and reciprocal microwave device which performs the standard mathematical transform (i.e., a spatial fourier transform) of a linear array. Butler matrices and their operation are known in the art. Butler Matrix 117 of FIG. 3 is a four port butler matrix, which has a set of four inputs A, B, C and D and a set of four outputs A', B', C' and D'. Butler Matrix 117 includes four 90° phase lead hybrids 118 (FIG. 3*a*) and two 45° phase shifters 120 interconnected to one another and to the two sets of four inputs A, B, C and D as shown. The four port matrix 117 is considered here for simplicity, but one skilled in the art will appreciate that Butler Matrixes can be designated with any number of desired ports (i.e., Butler Matrix 117 of FIG. 2 is a $\log_2 N$ stage Butler Matrix having N input and output ports) as is described in a paper entitled "Butler Network Extension to any Number of Antenna Ports" by H. E. Foster and R. E. Hiatt, IEEE TRANSACTIONS ON ANTENNAS AND PROPAGATION, (November 1970).

In the traditional use of the aforementioned Butler Matrix 117, ports A, B, C and D would be the input ports, and ports A', B', C', and D' would be the output ports and would be attached to radiator elements of an antenna system. In particular, and in accordance with the base station 100 of the present invention, each input port of the Butler Matrix 117 is decoupled from the remaining N-1 other input ports. Therefore, there is no inherent loss if RF signals are combined into the same frequency band. Further, the Butler Matrix 117 is configured such that the signal applied at one input port (A, B, C or D) is divided equally among all the output ports which results in signals of equal amplitude and linear phase gradient at output ports A', B', C' and D' whereby the phase gradient is determined by which input port is excited. Further, exciting a single input port results in a specific far field radiation or mode pattern. Thus, the signal phases from the output ports of Butler Matrix 117 are configured to form distinctive narrow electromagnetic beams from the output ports which are unique to each input port. A Butler Matrix 117 which is suitable to be implemented in the antenna systems of the present invention described herein is Part No. P.O.- CJEO43992, commercially available from Anaren.

Figure 4:
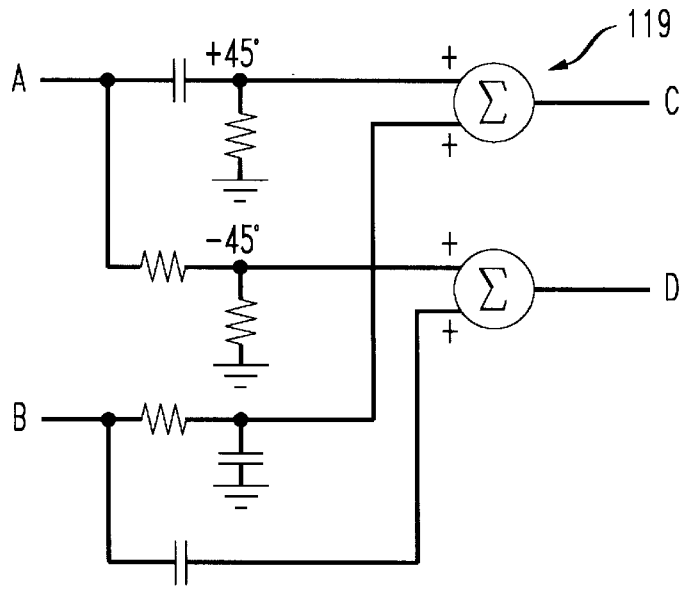
FIG. 4 is a circuit diagram of a quadrature hybrid coupler implemented in the power sharing network of FIG. 2 in accordance with another preferred embodiment of the present invention.

However, as mentioned above, the power sharing network 112 is not to be understood to be limited to the aforementioned Butler Matrix 117, but rather may encompass any equivalent circuitry, such as a quadrature hybrid coupler as illustrated in FIG. 4, designated generally by reference numeral 119. Quadrature hybrid couplers 119 are known in the art and therefore do not need to be described herein.

Referring back to FIG. 2, the power sharing network 112 enables antenna aperture sharing whereby N narrow electromagnetic beams 124 are formed by N broadbeam antenna elements 110 (coupled to power sharing network 112) since the power sharing network 112 properly phases the signal from an input port 113 to a corresponding radiated beam 124. Thus, instead of N narrow beam antenna apertures for N electromagnetic beams (as in the prior art narrow beam antenna system of FIG. 1) a single broadbeam antenna aperture having an array of broadbeam antenna elements 110 is used to form N narrow electromagnetic beams 124. Further, since the aforementioned narrow electromagnetic beam 124 formation facilitated by power sharing network 112 is provided by the N broadbeam antenna elements 110 which each have less than a 120° beamwidth, an omni directional base station coverage thus requires at least three power sharing networks 112, which results in an antenna aperture of a single narrowbeam antenna (360°).

Antenna system 100 further includes N linear power amplifiers 126 respectively coupled intermediate the N broadbeam antennas elements 110 and the N output ports of power sharing network 112. Each N linear power amplifier 126 is operative to increase the power level of a RP signal radiated from a respective broadbeam antenna element 110 coupled thereto, wherein the output signal of the linear power amplifier 126 is essentially proportional to its input signal. An example of aforementioned linear power amplifier 126 and broadbeam antenna 110 adapted for implementation in the antenna system of the present invention described herein is respectively Part No. ZHL-2-50P3, commercially available from Mini-Circuits and Part No. AG-1384, commercially from Radiation systems, Inc.

Therefore, power sharing network 112 is operative to enable each N electromagnetic narrowbeam 124 to equally distribute usage of the N linear power amplifiers 126. The aforementioned equal distribution of the N linear power amplifiers 126 preferably corresponds to the situation when all the N electromagnetic narrowbeams 124 of the N broadbeam antenna elements 110 share a common planar antenna aperture (i.e., forming N electromagnetic narrowbeams over a 120° sector).

As mentioned above, each linear power amplifier 126 is coupled to a power sharing network 112 which is configured to distribute each N input signal 158 to all N linear power amplifiers 126 with equal power distribution. Therefore, regardless of how RF transmitting signals are distributed among the N input ports of the power sharing network 112, the N linear power amplifiers 126 equally handle the same average power relative to the transmitting electromagnetic signals.

The aforementioned equal power distribution of the N linear power amplifiers 126 provides advantages over the prior art base station 10 (FIG. 1) in that the power level in each linear power amplifier 16 (FIG. 1) varies in accordance with the RF traffic distribution therein with a particular narrow beam antenna 12. The maximum average power per linear power amplifier 126 in accordance with the present invention is proportional to the maximum number of RF channels (K) served by the antenna system 100 and the number (N) of linear power amplifiers 126 provided therein. For example, in the prior art, if M is to be designated the number of RF channels served by any given electromagnetic beam, then the average power per linear power amplifier is only proportional to M. However, with the aforementioned antenna system 100 of the present invention, the average power per linear power amplifier 126 is proportional to K/N when functioning with K number of RF channels which is advantageous in that it prevents over-saturation of the linear power amplifiers 126 while increasing trunking efficiency.

Figure 5:
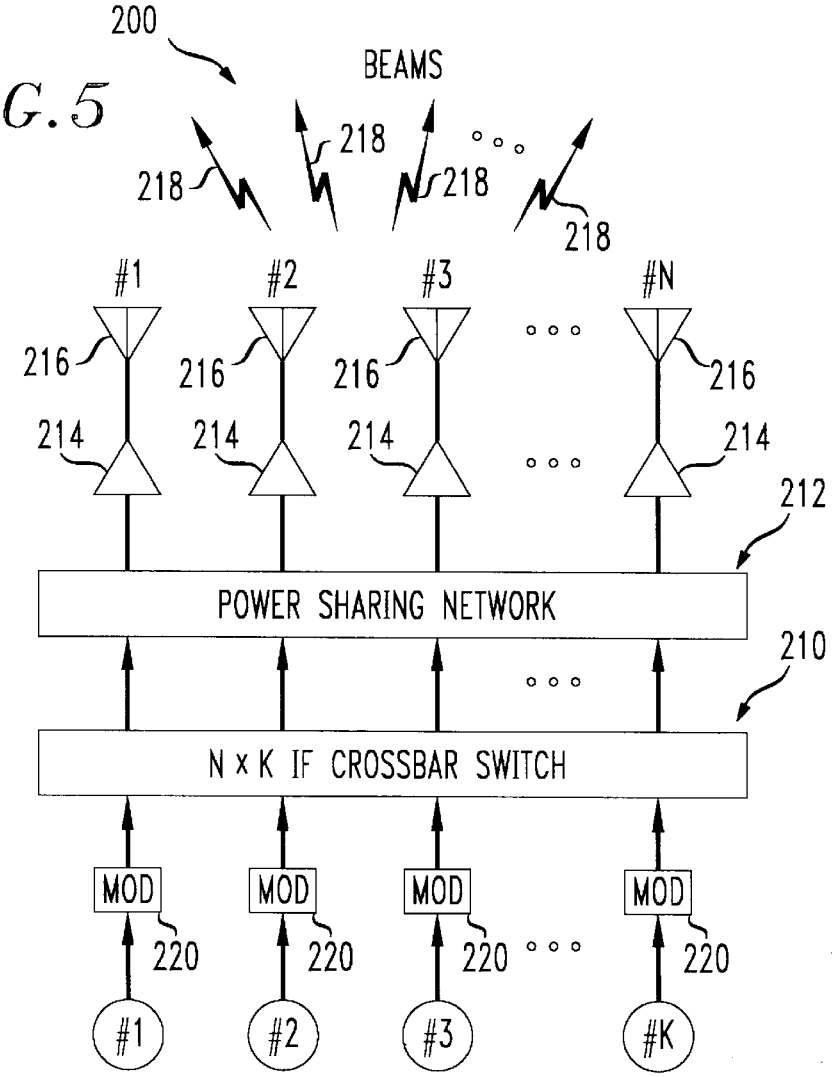
FIG. 5 is a block diagram of the antenna system of FIG. 1 adapted to enable signal transmitting capabilities.

FIG. 5 illustrates an antenna system 200 adapted to have transmitting capabilities and which incorporates an intermediate frequency (IF) crossbar switch 210 which is functional to reduce the number of modulators needed to serve K electromagnetic channels. Crossbar switch 210 is a switch having a plurality of vertical paths, a plurality of horizontal paths, and electromagnetically-operated mechanical means for interconnecting any one of the vertical paths with any one of the horizontal paths. The antenna system 200 further includes a power sharing network 212 which has its N outputs respectively connected to N linear amplifiers 214, which in turn are respectively coupled to N broadbeam antenna elements 216. As mentioned above, each broadbeam antenna element 216, in conjunction with the power sharing network 112, is adapted to respectively provide an electromagnetic narrowbeam 218, and to equally share in the power distribution of the N linear power amplifiers 214 coupled thereto. The N input ports of the power sharing network 212 are respectively coupled to the IF crossbar switch 210, which in turn, is coupled to K modulators 220. The arrangement of the IF crossbar switch 210 being coupled to the power sharing network 212 provides advantages over the prior art system of FIG. 1, in that it reduces the number of modulators needed to serve K RF channels from M×N . An example of the modulators 220 and IF crossbar switch 210 which may be implemented in the antenna system of the present invention described herein are commercially available as a single unit from AT&T as an Auptoplex® cell site base station.

Figure 6:
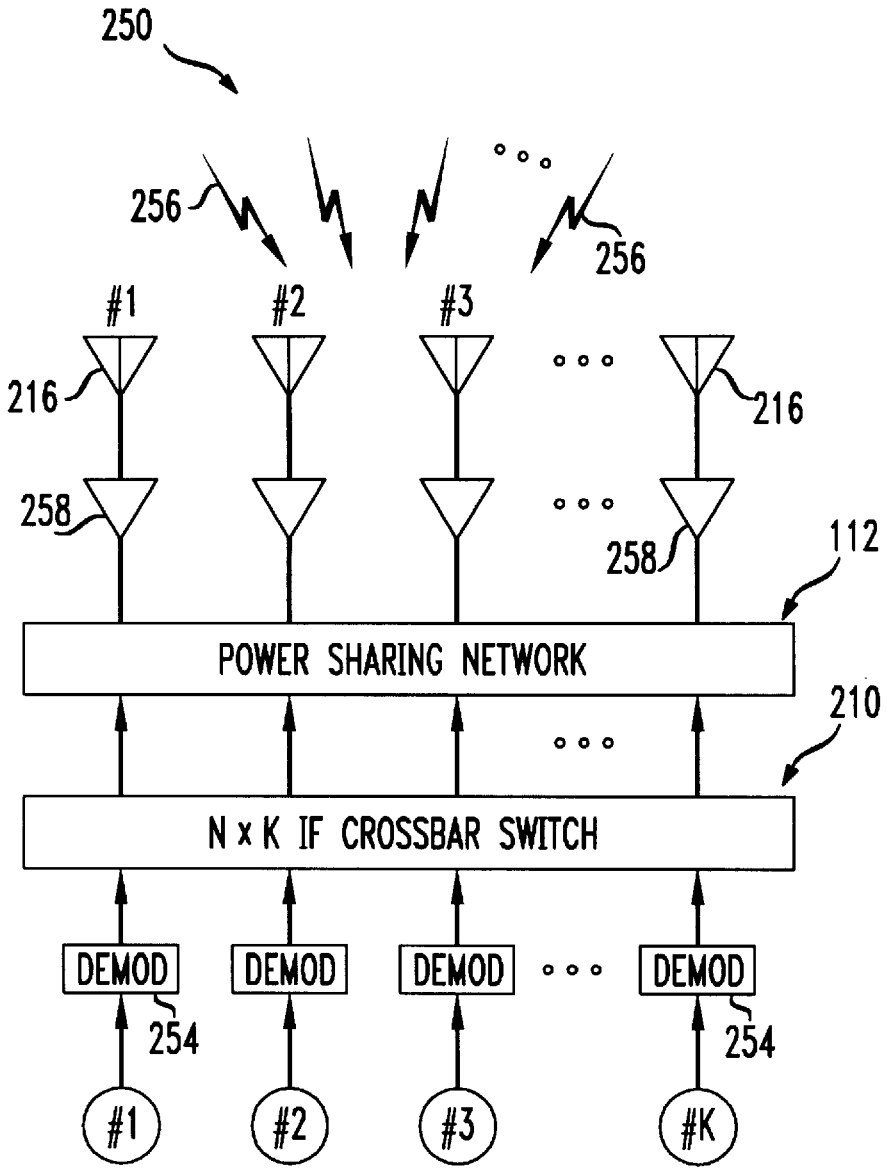
FIG. 6 is a block diagram of the antenna system of FIG. 5 adapted to enable signal reception capabilities.

Referring now to FIG. 6, an antenna system 250 is shown having signal reception capabilities. Antenna system 250 incorporates a power sharing network 112 and is substantially similar to the antenna system 200 of FIG. 5 except for the exclusion of the K modulators 220 and the provision of K demodulators 254 thereof being coupled to the IF crossbar switch 210, and the exclusion of the N linear power amplifiers 126 and the provision of N pre-amplifiers 258 thereof. Pre-amplifier 258 is an amplifier connected to a low-level signal source (broadbeam antenna elements 216) and is adapted to present suitable input and output impedances and provide an appropriate amount of gain whereby the electromagnetic signal may be further processed without appreciable degradation in the signal-to-noise ratio. The K demodulators 254 enable antenna system 250 to have receiving capabilities, wherein the K demodulators 254 are operative to de-modulate a received signal 256, via antenna elements 216, to its original modulating wave. Antenna system 250 is adapted to provide an electromagnetic narrowbeam signal to each aforementioned K demodulator 254, via the N broadbeam antenna elements 216. The aforementioned electromagnetic narrowbeam signals are provided by the power sharing network 112 through antenna aperture sharing of the broadbeam antenna elements 216 associated therewith.

Figure 7:
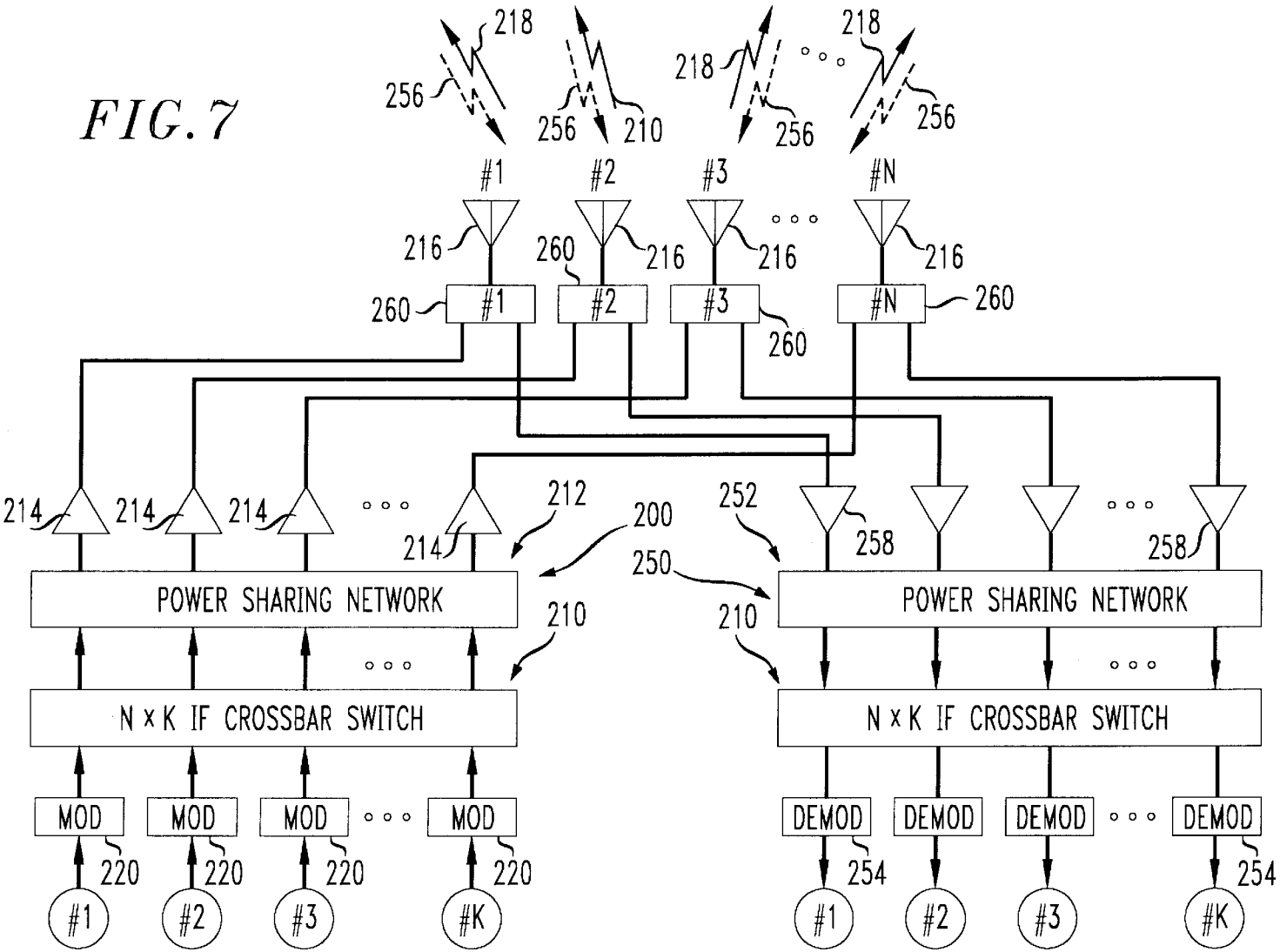
FIG. 7 is a block diagram of the antenna system of the present invention employing a plurality of circulators to couple the antenna systems of FIGS. 5 and 6 to one another.

With reference now to FIG. 7, the above-described transmitting and reception antenna systems 200 and 250 may preferably be coupled to one another so as to form an antenna system having both a transmitting portion 200 and a reception portion 250. Preferably, the aforementioned N broadbeam antenna elements 216 are coupled to both the transmitting 200 and reception portion 250 of such an antenna system. For example, to enable the aforementioned diplexing operation between the transmitting portion 200 and the receiving portion 250 of the above mentioned antenna systems, N conventional diplexers and/or circulators 260 may preferably be provided to facilitate simultaneous transmission or reception of two signals utilizing a common broadbeam antenna element 216.

Figure 8:
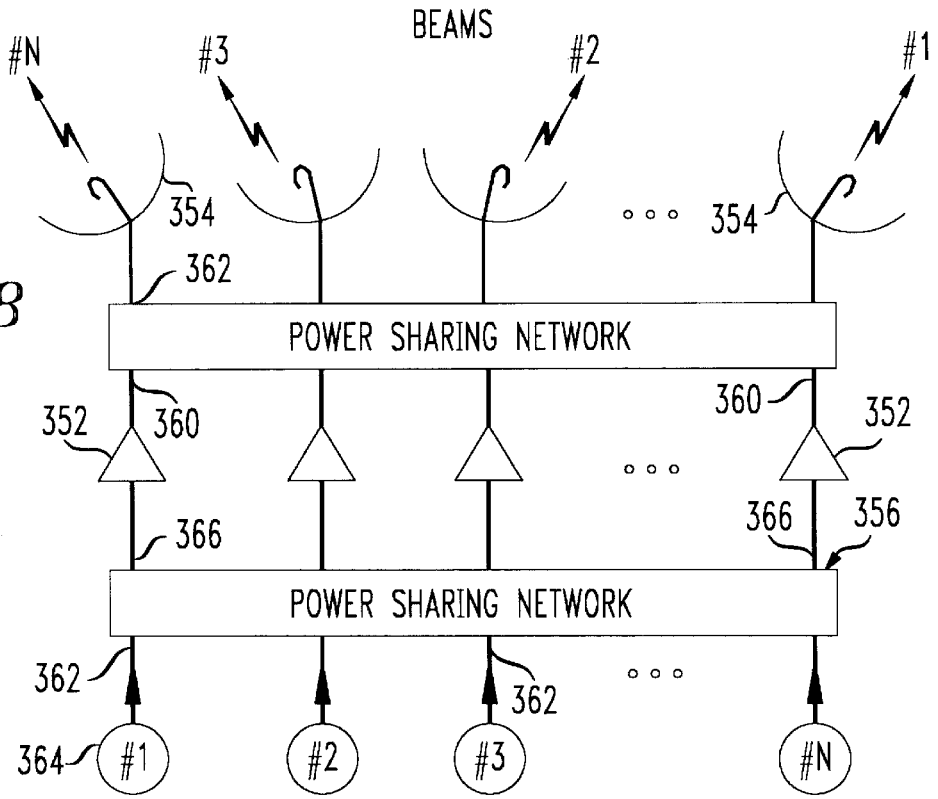
FIG. 8 is a block diagram of an antenna system having a power sharing network of a configuration to equally distribute amplifier power to narrowbeam antennas in accordance with the present invention.

Another alternative embodiment of the present invention is illustrated in FIG. 8, wherein antenna system 300 is adapted to equally distribute the power of N linear power amplifiers 352 to N narrowbeam antennas 354. Each narrowbeam antenna 354 has its own antenna aperture, thus the antenna system 300 is adapted to equally distribute linear amplifier 352 power to an input signal at an RF channel 364. To effect such power distribution, antenna system 300 includes a first power sharing network 356 and a second inverse power sharing network$^{-1}$ 358. Briefly, the inverse power sharing network$^{-1}$ 358 includes an inverse Butler Matrix in comparison to the Butler Matrix employed in the first power sharing network 356. The second power sharing network 358 essentially identical to the first power sharing network 356 with the exception that the output ports are now used as input ports. An RF signal fed into one port of the first power sharing network 356 will only appear at the corresponding output port of the inverse power sharing network$^{-1}$ 358. The correspondence between input ports of 356 and output ports of 358 are found by reversing the left-to-right sequence to right-to-left. Briefly, the output signal of the inverse power sharing network$^{-1}$ 358 is an inverse fourier transform relative to the output signal of the first power sharing network 356.

The first power sharing network 356 has N input ports 362 which are respectively coupled to N RF channels 364. Power sharing network 356 is further provided with N output ports 366 which are respectively coupled to the N linear power amplifiers 352. These amplifiers are respectively coupled to the N input ports 360 of the second power sharing network$^{-1}$ 358, wherein the N output ports 362 of the second power sharing network 358 are respectively coupled to the N narrowbeam antennas 354. In operation, the first power sharing network 356 distributes the N input signals 364 (each signal consisting of a group of RF channels destined for a given antenna beam) from one of its respective input ports 362 to the N linear power amplifiers 352, via output ports 366, with equal power distribution. The second power sharing network$^{-1}$ 358 is operative to concentrate the aforementioned amplified input signals back to the originally destined narrowbeam antenna 354 by exciting only the output port 362 of the second power sharing network$^{-1}$ 358 which corresponds to a particular input port 362 of power sharing network 356 to which the input signal was applied.

Figure 9:
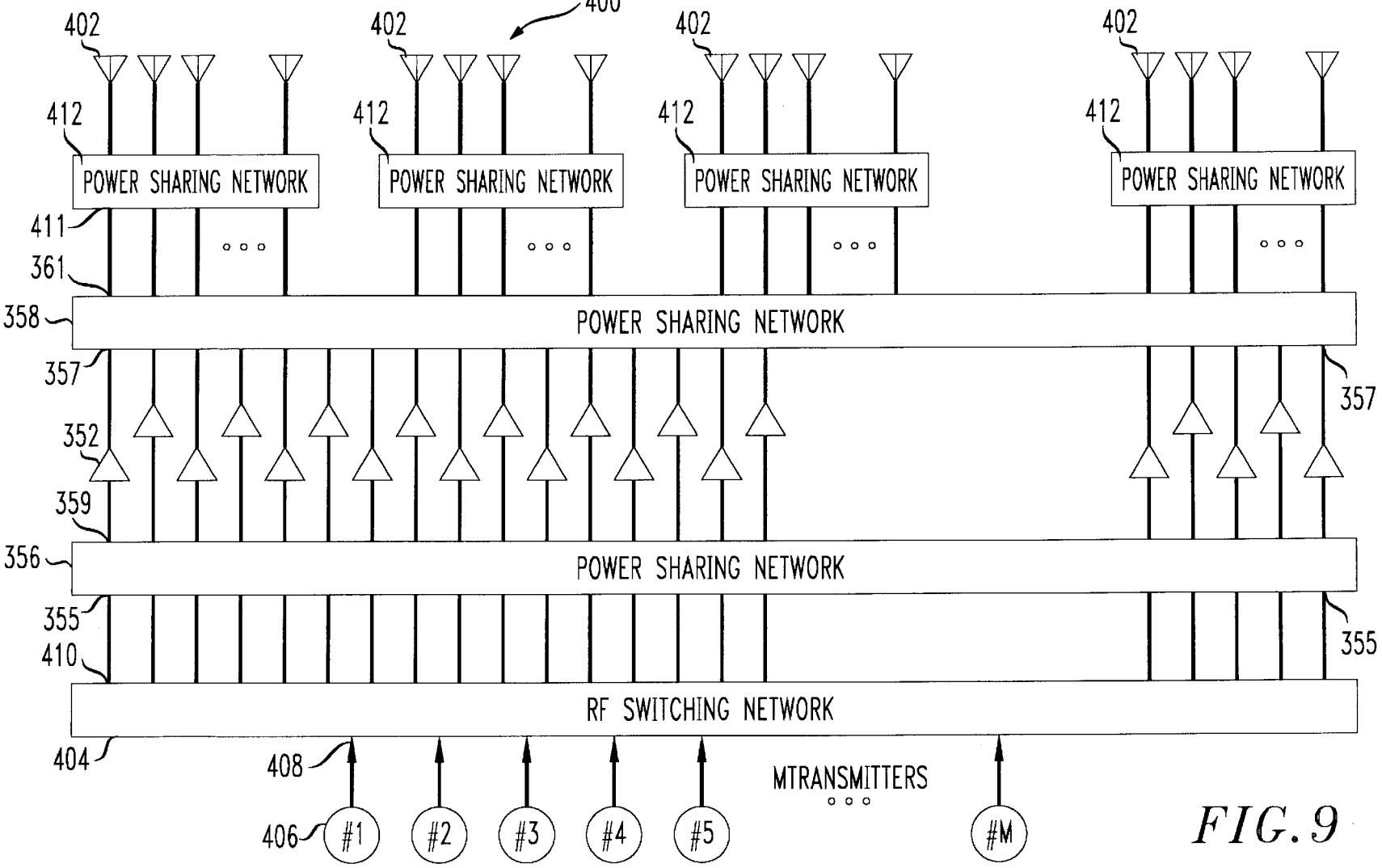
FIG. 9 is a block diagram of the antenna system of FIG. 8 configured to utilize broadbeam antenna elements.

Yet another alternative embodiment of the present invention antenna system is illustrated in FIG. 9, designated generally by reference numeral 400. Briefly, antenna system 400 is adapted to equally distribute the power of N linear power amplifiers 352 to a plurality of broadbeam antenna elements 402. Antenna system 400 is similar to antenna system 300 described above in that antenna system 400 utilizes the above described arrangement of the first power sharing network 356 and second power sharing network 358 to effect equal power distribution of the N linear power amplifiers 352 coupled therebetween. However, as will be described below, antenna system 400 utilizes a plurality of broadbeam antenna elements 402 for providing directional resolution of multiple RF signal transmission beams therefrom, in contrast to the narrowbeam antenna elements 352 of antenna system 300.

Antenna system 400 includes an RF switching network 404 having M input ports 408 and N output ports 410, wherein its M input ports 408 are respectively coupled to M RF transmitters 406, while its N output ports 410 are respectively coupled to the N input ports 355 of the first power sharing network 356. A plurality of third power sharing networks 412 are coupled to the N output ports 361 of the second inverse power sharing network 358. Coupled to the respective output ports 413 of each third power sharing network 412 is a broadbeam antenna element 402.

Therefore, antenna system 400 is configured such that an RF signal from one of the M RF transmitters 406 is received at one of the M input ports 408 of the RF switching network 404. The RF switching circuit 404 then selectively switches the aforementioned RF signal to one of its N output ports 410. The RF signal is then coupled to a corresponding N input port 355 of the first power sharing network 356, wherein the RF signal is distributed and equally amplified by the N linear power amplifiers 352. The second inverse power sharing network 358 receives the N amplified RF signals at its respective N input ports 357 and is operative to concentrate the aforementioned amplified RF signals to an N output port 361 which corresponds with the N input port 355 of the first power sharing network 356 which originally received the RF signal, via the RF switching network 404. The aforementioned concentrated RF signal is then received at a corresponding input port 411 of a third power sharing network 412 associated with the aforementioned output port 361 of the second inverse power sharing network 358 which provides the concentrated RF signal. The third power sharing network 412 is then operative to radiate the concentrated RF signal from the broadbeam antenna elements 402 associated therewith in directional narrowbeam transmission signals, as described above.

Figure 10:
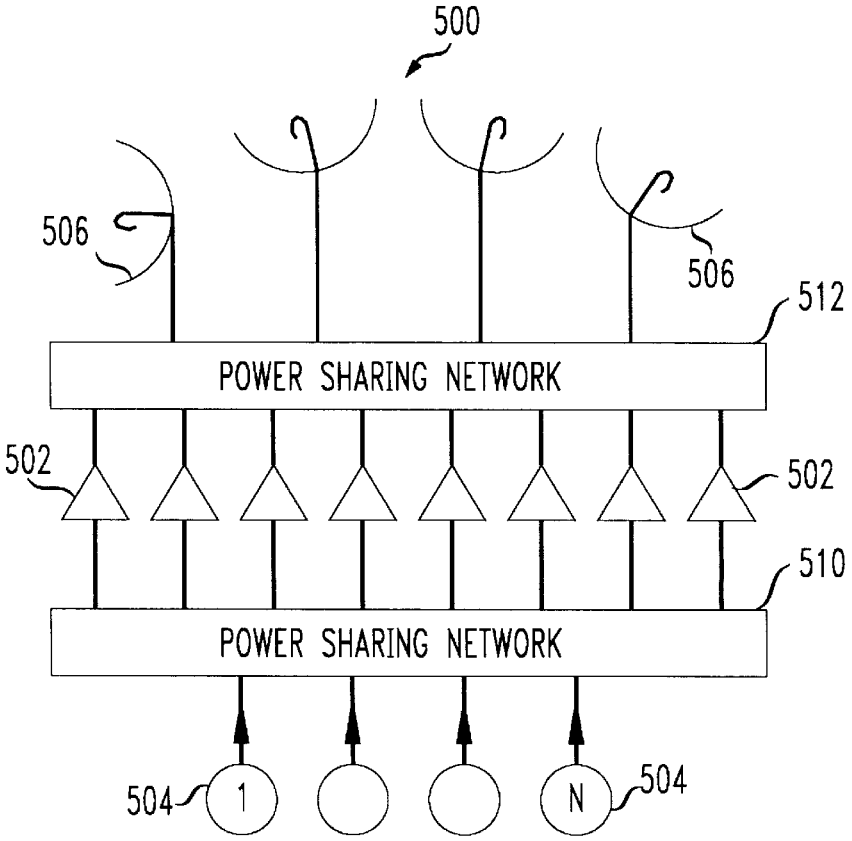
FIG. 10 is a block diagram of the antenna system of FIG. 8 configured to utilize a greater number of linear amplifiers than narrowbeam antenna elements provided.

Still another preferred embodiment of the present invention antenna system is illustrated in FIG. 10, designated generally by reference numeral 500. Antenna system 500 is similar to antenna system 300 described above in that antenna system 500 utilizes the above described arrangement of the first power sharing network 510 and second power sharing network 512 to effect equal power distribution of the M linear power amplifiers 502 coupled therebetween. However, as will be described below, antenna system 500 utilizes a greater number of amplifiers 502 relative to antenna elements 506.

Briefly, antenna system 500 is provided with M linear power amplifiers 502 and N transmitters 504 and antenna elements 506, wherein M>N. This arrangement is advantageous in that the increased number of linear power amplifiers 502 provides a more efficient antenna system. In particular, the increased number of linear power amplifiers 502 preferably enables the utilization of lower level power amplifiers relative to the power level of a linear power amplifier when there are N linear power amplifiers and antenna elements. The aforementioned utilization of the foregoing comparatively low level power amplifiers 502 is advantageous in cost efficiency as the monetary cost of power amplifiers considerably increases as its power rating increases, as is well known.

Further, the redundancy effect of having M linear power amplifiers 502 serving N antenna elements 506 (wherein M>N) is advantageous in that if one or more linear amplifiers 502 fail, antenna system 500 still remains operable in that each antenna element 506 receives an amplified signal equally from the remaining operable linear power amplifiers 502. For example, in the prior art system (See FIG. 1), each antenna element 14 was coupled to a dedicated power amplifier 16, and when such a dedicated power amplifier 16 failed, the antenna element 14 coupled thereto was inoperable to radiate an electromagnetic beam therefrom.

Yet a further advantage of employing M low level power amplifiers 502 is a lessening in the cooling requirements for the antenna system 500, since the cooling requirements for a linear power amplifier increases as its power rating increases, as is well know.

Antenna system 500 includes first and second power sharing networks 510 and 512 each respectively having M input ports and output ports. As mentioned above, each first and second power sharing network 510 and 512 is preferably a Butler matrix having M input ports and M output ports wherein a spatial fourier transform is interpolated on an input signal thereinto.

Coupled to the N of the M input ports of power sharing network 510 is respectively N RF transmitters 504 each being adapted to provide an input RF signal. Thus, only N of the M input ports of power sharing network 510 are utilized. Coupled to the M output ports of power sharing network 510 are the M linear power amplifiers 502, which are further respectively coupled to the M input ports of the second power sharing network 512. Coupled to N of the M output ports of the second power sharing network 512 is the N antenna elements 506, wherein the N utilized output ports of the second power sharing network 512 respectively corresponds to the aforementioned N utilized input ports of the first power sharing network 510. Each antenna element 506 is preferably a narrowbeam antenna element being configured to radiate a directional resolution electromagnetic signal therefrom.

In operation, an RF input signal is provided by one of the N transmitters 504 and is received by one of the M input ports of the first power sharing network 510 and is provided at the M output ports thereof, as described above. The input RF signal is then distributed to the M linear power amplifiers 502 coupled thereto for amplification, as also described above. The M amplified RF signals are then respectively received at the M input ports of the second power sharing network 512, whereby the second power sharing network 512 is operative to concentrate the aforementioned amplified input signals back to the originally destined narrowbeam antenna 506 by exciting only the utilized N output port of the second power sharing network 512 which corresponds to the particular input port of the first power sharing 510 to which the input signal was applied, via a corresponding N transmitter 504.

An additional advantage of using M amplifiers for N beams with M>N is that the intermodulation between different beam signals introduced by nonlinearities in the various amplifiers can often only appear at unused output ports of network 512 and thus terminate instead of being radiated therefrom.

Figure 11:
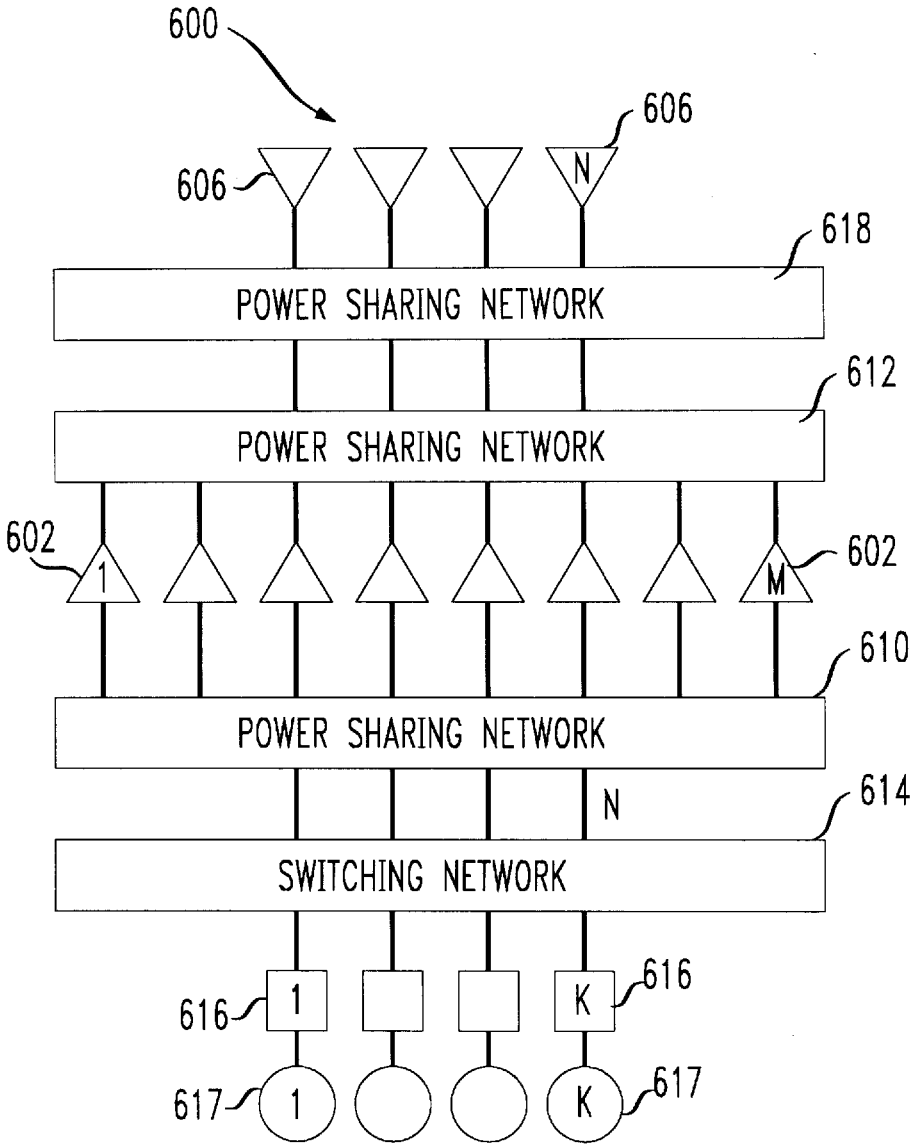
FIG. 11 is a block diagram of the antenna system of FIG. 10 configured to utilize broadbeam antenna elements.

Still another preferred embodiment of the present invention antenna system utilizing the foregoing arrangement of providing a greater number of power amplifiers relative to antenna elements is illustrated in FIG. 11, designated generally by reference numeral 600. Briefly, antenna system 600 is similar to antenna system 500 described above, however antenna system 600 is adapted to equally distribute the power of M linear power amplifiers 602 to N broadbeam antenna elements 606 for providing directional resolution of multiple RF signal transmission beams therefrom, in contrast to the narrowbeam antenna elements 506 of antenna system 500. As with antenna system 500, antenna system 600 provides the aforementioned advantages of having a greater number (M) of amplifiers 602 relative to the number (N) of antenna elements 606.

Antenna system 600 includes an intermediate frequency (IF) crossbar switch 614 having K input and N output ports. Respectively coupled to the N input ports of switch 614 are K modulators 616 which in turn are each coupled to an RF signal source 617. The N output ports of switch 614 are coupled to N of the M input ports of the first power sharing network 610. The M output ports of the first power sharing network 610 are coupled to M linear power amplifiers 602 which are respectively coupled to the M input ports of the second power sharing network 612. N of the M output ports of the second power sharing network 612 are coupled to the N input ports of the third power sharing network 618, wherein N output ports of the third power sharing network 618 are each respectively coupled to a broadbeam antenna element 606. As described above, each respective first and second power sharing network 610, 612 is preferably a Butler Matrix having M input and output ports, while the third Butler Matrix includes N input and output ports. As also mentioned above, only N of the M input ports of the first Butler Matrix 610 and the corresponding N output ports of the second Butler Matrix 612 are utilized by antenna system 600.

Antenna system 600 is operational such that the first power sharing network 610 receives an input signal at one of the N utilized input ports and outputs the received signal at all of its M output ports so as to be each respectively amplified by the M linear power amplifiers 602 coupled thereto. The M amplified signals are then respectively received at the M input ports of the second power sharing network 612 which is operational to concentrate the aforementioned amplified signals to a particular utilized N output port which corresponds with the utilized N input port of the first power sharing network 610 which originally received the RF signal, via switch 614. The aforementioned concentrated signal is then received at a corresponding N input port of the third power sharing network 618 which is operative to provide an output signal at each of its N output ports which are a function of the concentrated RF signal, wherein each output signal is in substantially equal power levels and is staggered in angular phase relationship to one another, as described above. As also described above, each output signal is radiated from a respective broadbeam antenna element 606 providing directional resolution of an RF signal transmission beam from the combination of antenna elements 606.

In operation of the above described antenna systems of the present invention, electromagnetic narrowbeam transmission and reception at preferably a centrally located Advanced Mobile Phone Service (AMPS) base station incorporating one of the above described antenna systems is provided with either increased coverage range or a reduction in the required transmitter power and interference. Further, no frequency reuse is involved, (i.e., handing off from electromagnetic beam to electromagnetic beam does not involve a new channel assignment and is handled by switching in the same base station to different narrow electromagnetic beams). For example, if omni directional coverage is divided into 10 electromagnetic narrow beams, a 10 dB signal power gain advantage is achieved and the total average interference power is reduced significantly.

The above described base stations of the present invention constituted as improvement over prior art antenna systems by utilizing a Butler Matrix to effect equal component (antenna, linear power amplifier, modulators, demodulators, etc.) distribution. This "improvement factor" is defined as: MN\K, wherein N is the number of RF antenna beams, K is the maximum channel demand that can be served per base station, and M is the channel demand that each electromagnetic beam would be equipped to meet under non-distributing conditions. This factor is derived by solving for M as a function of both N and K, under the assumption of uniform RF traffic. For example, if all the equipment at a base station is shared through the use of Butler Matrixes, as described above, the blocking probability (B) of the base station is given in terms of the overall Erlang traffic demand (a) and the number of transponders (K), by the Erlang B formula, which is defined as:

$$B(K, a) = \frac{a^K}{K! \sum_{n=o}^{K} \frac{a^n}{n!}}$$

In another example, a scenario of no antenna sharing is considered where it is assumed that the signal traffic demand has uniform independent probability distribution among the N electromagnetic beams. In order to handle the same overall RF traffic, the traffic per beam would be $a_b$=a/N. Therefore, in order for each user in any given electromagnetic beam to see the same service as would experience in the totally shared base station, it is required that the blocking probability per beam ($B_b$) be the same as the overall blocking probability (B) of the totally shared base station. Therefore, by inserting $a_b$ and $B_b$ back into the Erlang B formula, it is determined that by substituting M for K, wherein M is the minimum number of transponders per beam that provides a per beam blocking probability ($B_b$) is less than or equal to B. Further, if K and N are known values, and B is specified, then the required value for M is determined as described above to determine the improvement factor; MN/K.

Figure 12:
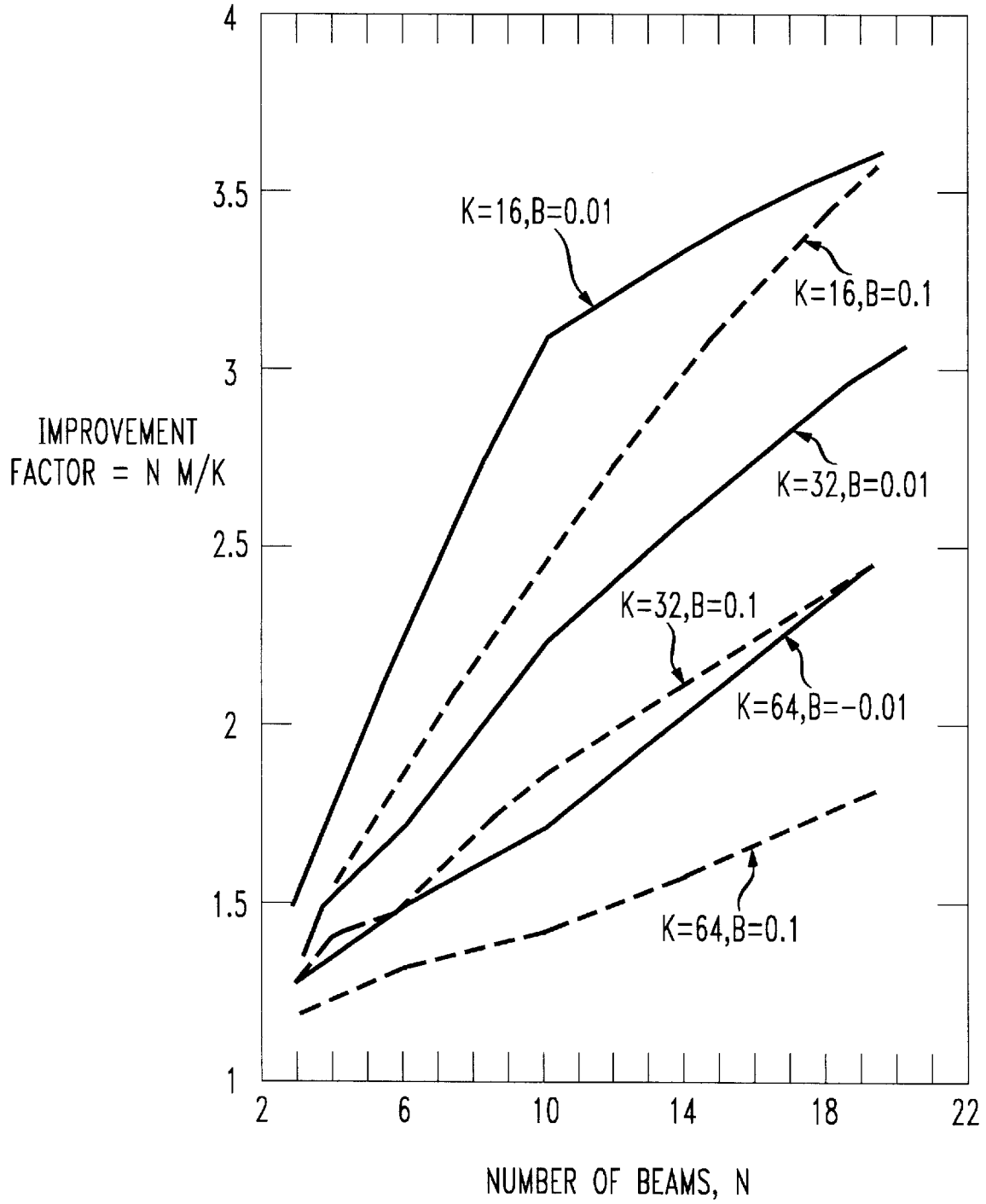
FIG. 12 is a graph illustrating transponder reduction through amplifier power sharing.

Referring now to FIG. 12, the solid curves which represent MN\K versus N, with K as a parameter, wherein B is prescribed to equal 0.01 (which is when the peak demand occurs for which a given base station is designed, the probability that all of the N beams will meet their demands is 99%). The dashed curves in FIG. 10 are representative of the corresponding results for when B is to equal 0.10. It is particularly noted that the improvement factor grows with N and diminishes with K, which results in that traffic fluctuates more from electromagnetic beam to electromagnetic beam when the average per electromagnetic beam demand (K\N) is small.

While the invention has been particularly shown and described with reference to certain preferred embodiments, it will be understood by those skilled in the art that various modifications in form and detail may be made therein without department from the scope and spirit of the invention. Accordingly, modification to the preferred embodiments will be readily apparent to those skilled in the art, and the generic principles defined herein may be applied to other embodiments applications without departing from the spirit and scope of the invention. Thus, the present invention is not intended to be limited to the embodiments shown, but it is to be accorded the widest scope consistent with the principles and features disclosed herein.

What is claimed is:

1. A ground-based base station in a wireless communication system, comprising:

a transmitting system, comprising:

a power sharing network having a plurality of input ports and a plurality of output ports, said power sharing network operable to receive a plurality of input information signals at the input ports thereof, wherein said input information signals correspond to information-bearing signals originating from a telephone network linked to said base station, said power sharing network operable to divide each said information signal among a plurality of output ports thereof with a staggered phase relationship therebetween to thereby provide a plurality of first output signals of substantially equal power levels;

a plurality of linear amplifiers, each for amplifying one of said first output signals to provide a corresponding amplified signal;

a plurality of antenna array elements coupled to outputs of said amplifiers, said antenna elements being excited by said amplified signals so as to radiate output information signals in multiple, high gain antenna beams, each pointing in a distinct azimuthal direction, with each output information signal corresponding to one of said input information signals and transmitted on an associated one of said antenna beams; and a switching network operable to selectively switch said input information signals to the input ports of said power sharing network, wherein a signal transmission to a wireless terminal in the wireless communication system is handed off from one of said antenna beams to another of said antenna beams without assigning a new frequency channel for the signal transmission.

2. The base station of claim 1 wherein said power sharing network comprises a Butler matrix.

3. The base station of claim 1 wherein said base station comprises an Advanced Mobile Phone Service (AMPS) base station.

4. The base station of claim 1, wherein said power sharing network has N input ports, and said switching network comprises a N×K intermediate frequency (IF) crossbar switch with K input ports and N output ports.

5. The base station of claim 1, wherein each said input information signal comprises a group of RF frequency channels.

6. A method for transmitting wireless communication signals from a ground-based base station linked to a telephone network, comprising the steps of:

providing, at the base station, a power sharing network having a plurality of input ports and a plurality of output ports, said power sharing network operable to divide an input signal applied to any input port thereof among its output ports with a staggered phase relationship at the output ports, with the phase relationship depending upon which input port the input signal is applied;

applying a plurality of input information signals to respective input ports of said power sharing amplifier network to produce a plurality of composite signals at respective output ports of said power sharing network;

linearly amplifying each said composite signal to provide corresponding amplified signals;

exciting a plurality of antenna array elements with said amplified signals so as to radiate output information signals from said base station in multiple, high gain antenna beams, each pointing in a distinct azimuthal direction, with each output information signal corresponding one of said input information signals and transmitted on an associated one of said antenna beams; and, handing off a signal transmission to a wireless terminal from one of said antenna beams to another of said antenna beams by switching at the base station without assigning a new frequency channel for the signal.

7. The method of claim 6 wherein each said input information signal contains a group of RF channels destined for a given one of said antenna beams.

8. The method of claim 6 wherein said base station is an Advanced Mobile Phone Service (AMPS) base station.

* * * * *